US006349522B1

(12) United States Patent
Stevens

(10) Patent No.: US 6,349,522 B1
(45) Date of Patent: Feb. 26, 2002

(54) BRICK BLOCK AND PROCESS AND APPARATUS THEREFOR

(76) Inventor: Craig A. Stevens, P.O. Box 508, Derby, VT (US) 05825

( * ) Notice: Subject to any disclaimer, the term of this patent is extended or adjusted under 35 U.S.C. 154(b) by 0 days.

(21) Appl. No.: 09/557,949

(22) Filed: Apr. 24, 2000

Related U.S. Application Data

(63) Continuation-in-part of application No. 08/988,277, filed on Dec. 10, 1997, now abandoned.

(51) Int. Cl.[7] ..... E04G 9/10; E04G 15/06

(52) U.S. Cl. ..... 52/749.13; 52/314; 52/606; 52/745.19; 249/16; 249/17

(58) Field of Search ..... 249/16, 17; 52/311.1, 52/314, 316, 606, 749.13, 745.19; 425/385

(56) References Cited

U.S. PATENT DOCUMENTS

| | | | | | |
|---|---|---|---|---|---|
| 938,140 | A | * | 10/1909 | Goucher | 52/606 X |
| 1,285,217 | A | * | 11/1918 | Kemp | 249/17 X |
| 1,386,314 | A | * | 8/1921 | Carrier | 52/314 X |
| 1,472,516 | A | * | 10/1923 | Dula | 52/314 X |
| 2,199,112 | A | * | 4/1940 | O'Leary | 52/314 X |
| 2,295,216 | A | * | 9/1942 | Joy | 52/742.16 X |
| 2,577,215 | A | * | 12/1951 | Smith et al. | 52/314 X |
| 2,595,142 | A | * | 4/1952 | Herck | 52/316 X |
| 2,941,274 | A | * | 6/1960 | Wise et al. | 425/577 |
| 3,201,844 | A | * | 8/1965 | Poitras | 425/470 |
| 3,381,345 | A | * | 5/1968 | Williams | 249/16 X |
| 4,168,140 | A | * | 9/1979 | Fontana et al. | 249/16 X |
| 4,335,549 | A | * | 6/1982 | Dean, Jr. | 52/314 X |
| 5,361,977 | A | * | 11/1994 | Ogrodnick, Jr. | 52/314 X |
| 5,570,551 | A | * | 11/1996 | Koc, Sr. et al. | 52/314 |
| 5,761,861 | A | * | 6/1998 | Brackett | 52/314 X |
| 5,937,601 | A | * | 8/1999 | McDonald | 52/314 |

FOREIGN PATENT DOCUMENTS

| | | | | |
|---|---|---|---|---|
| CA | 480594 | * | 1/1952 | 52/314 |
| CA | 997582 | * | 9/1976 | 52/314 |
| FR | 1101365 | * | 10/1955 | 249/16 |

OTHER PUBLICATIONS

Craig, John J., "Introduction to Robotics, Mechanics and Control, Second Edition", Addison–Wesley Publishing Company, Inc. (5 pages, note especially pp. 287–288), 1989.*

Buchsbaum, Frank, "Design and Application of Small Standardized Components, Data Book 757", Stock Drive Products, (5 pages, note especially pp. 749–750), 1983.*

* cited by examiner

*Primary Examiner*—Laura A. Callo
(74) *Attorney, Agent, or Firm*—Lee A. Strimbeck

(57) ABSTRACT

An apparatus and process for the manufacture of brick block, i.e. a concrete chimney or wall block, with an impressed brick grout pattern on the face thereof, comprises a mold adapted to fit a known concrete block manufacturing machine. The mold has grout bars to impress a simulated laid brick pattern onto at least one vertical face of the block, the grout bar moveable in and out from a wall of the mold by hydraulic components. The hydraulic components utilize a unique multi-piston hydraulic block.

6 Claims, 11 Drawing Sheets

BRICK BLOCK AND PROCESS AND APPARATUS THEREFOR

RELATED APPLICATION

This application is a continuation-in-part of application Ser. No. 08/988,277 filed Dec. 10, 1997, now abandoned, having the same title and the same inventor.

The present invention is a brick block and process and apparatus for its manufacture. This invention is particularly useful for manufacturing chimney block having a brick pattern of preferably three courses impressed on all four vertical sides as well as for manufacturing wall block which may have a brick pattern on one, two or three sides.

THIS INVENTION

The brick block of this invention comprises a rectangular block of monolithic concrete colored throughout to imitate the color of brick. At least one vertical face of the rectangular block is horizontally and vertically grooved to create a pattern simulating laid brick. The grout lines contain a coloring agent (e.g. a pigmented latex) that simulates the color of a mortared joint. The brick block may be a chimney block, all four vertical sides of which have the impressed brick pattern. It may also be a wall block having two cores and having one to two sides faces with the brick pattern or if it be an end wall block having three sides of the block with the pattern.

By the term "brick block" is meant a molded monolithic concrete block colored throughout to simulate a natural brick color one vertical face of which has an impressed brick grout pattern simulating laid brick, one, two, and preferably at least three or more courses high.

The apparatus for the manufacture of the brick block comprises a mold having four vertical walls the interior of which has the dimensions of the desired brick block. One or more of the walls has means for impressing the grout pattern on the face of the brick block as it is molded. This means includes a hydraulic system that moves a grout bar outwardly into the concrete mass as it is being formed approximately ⅛ inch or so and after it is formed and before the block is ejected from the mold retracts the grout bar to be flush with the mold face.

The block has a core as is usual in the manufacture of conventional wall and chimney block. The concrete mixture has zero slump so that the impressed grout pattern is retained in the block as it is ejected from the mold. The concrete mixture has an increased moisture content while maintaining zero slump to produce on the "brick" face of the block, a brick-like surface. This results in the block having a higher density as compared to that of conventional wall block. The density is usually above 100 pounds per cubic foot, e.g. 103 pounds per cubic foot.

Ejection is accomplished by having a head or ram descend from the top of the mold around the core to push the block downwardly onto a platen which is then moved out from underneath the mold and set off for curing of the concrete mass.

The hydraulic mechanism that extends and retracts the grout bar has two or more hydraulic cylinders attached to the bar so that the grout bar remains square with the face of the mold.

The mold of the present invention is adapted to fit in or onto a conventional block manufacturing machine such as the "Bescopac" manufactured by Besser, 81 Johnson Street, Alpena, Mich. 49707. Because of the hydraulic mechanism required to impress the grout pattern, the mold is oversized or larger than that used for a standard block and some slight modification has to be made to the machine to receive the frame holding the present mold, namely, the width of the rubber dam is decreased.

Once the mold is in place, manufacture is quite straightforward. A charge of concrete, pre-colored throughout, is pushed into the mold cavity around a core or cores held in place by overhead hangers. As is conventional, the concrete is caused to settle in place by vibration during which time the grout bar is extended into the cement mixture and then is retracted after vibration has ceased. Following this, a head or ram descends into the mold to push the block out of the mold onto the platen on which it is removed. The core may be vented to prevent any vacuum forming which would distort the block. After the block has been allowed to cure, the grout lines of the brick pattern are painted as with a masonry slur or a pigmented latex the color of mortar.

The cycle time per brick block is 12 to 15 seconds. During a six-hour operating period, 1100 brick block have been made using one operator.

THE DRAWINGS

In the drawings.

In the drawings, the same part has the same number throughout.

DESCRIPTION

Figure 1:
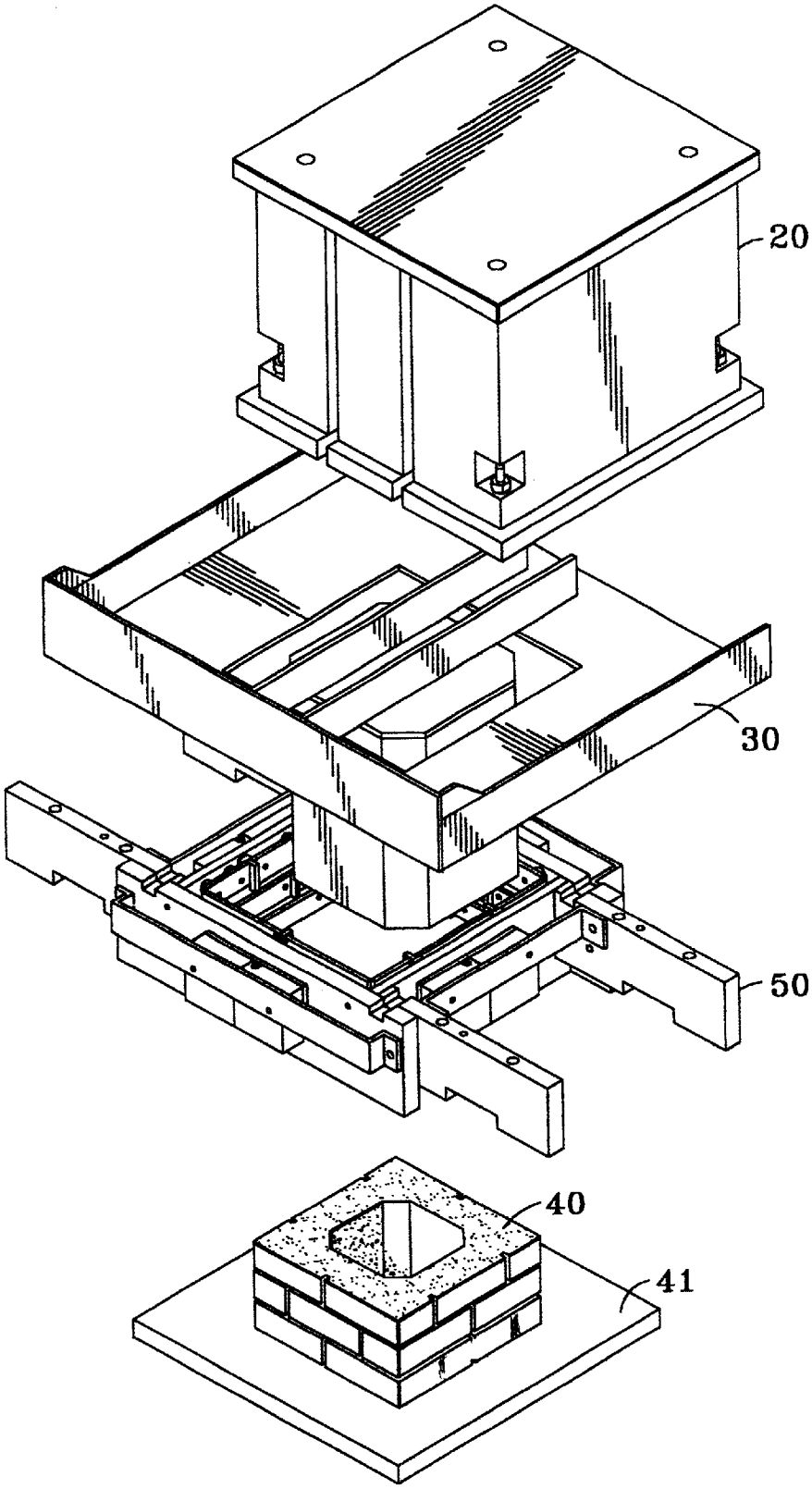
FIG. 1 is a prospective view of the component parts of the molding process showing their relative arrangement.

In FIG. 1 the head assembly is generally indicated at 20, the core assembly at 30, and the mold assembly at 50. A completed brick block is shown at 40 resting on a pallet 41 to be removed to curing and grout line coloring.

Figure 11:
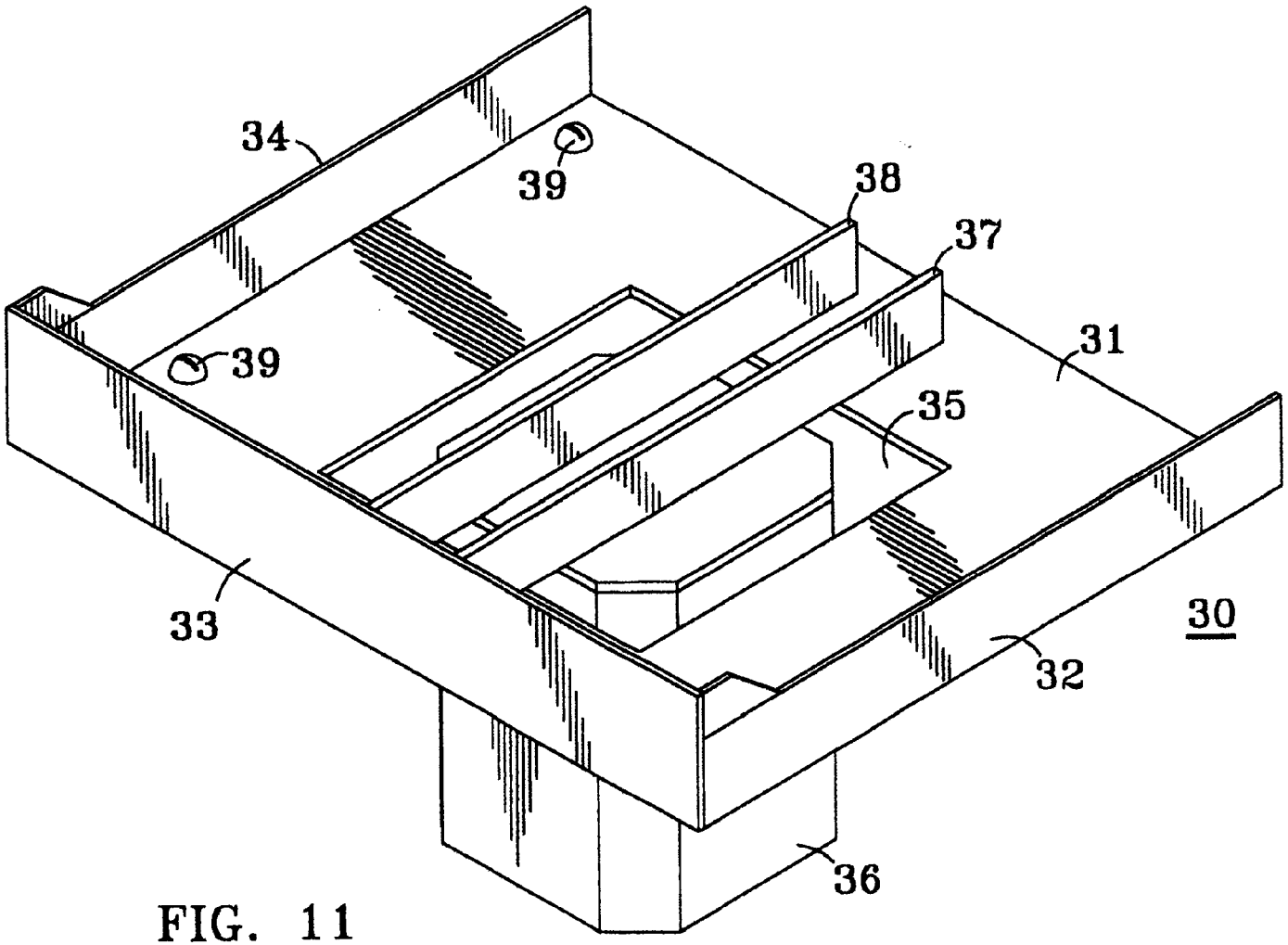
FIG. 11 is a prospective view of the core assembly.

Referring to FIG. 11, the core assembly, 30 fits onto the top of mold 50 and consists of a plate or tray 31 bounded on three sides by vertical walks 32, 33 and 34. Plate 31 has a rectangular opening 35 that mates with and allows the head plate 21 to pass through. A core 36 is suspended beneath plate 31 by means of vertical ribs 37 and 38 welded to both the core 36 and plate 31. Bolts 39 secure the core assembly to the mold frame. The core assembly shown is for the manufacture of chimney block having a single core. If wall block is to be manufactured, two cores are customary. In operation, the charge of concrete is placed in the mold by pushing it onto plate 31 from the open side into opening 35.

Figure 13:
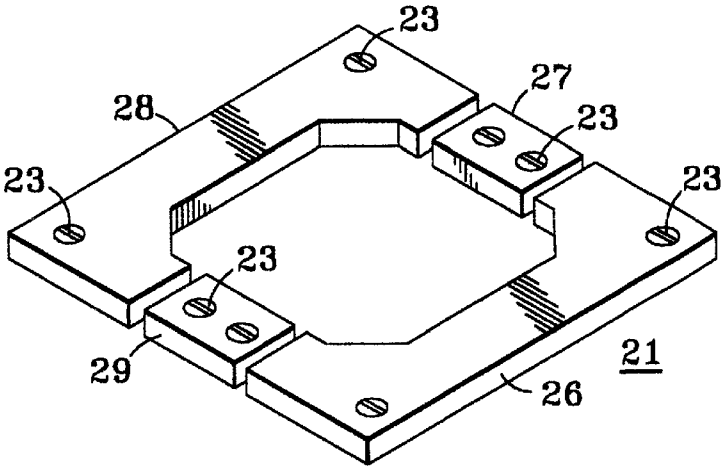
FIG. 13 is a prospective view of the underside of the head plate of the head assembly.
Figure 12:
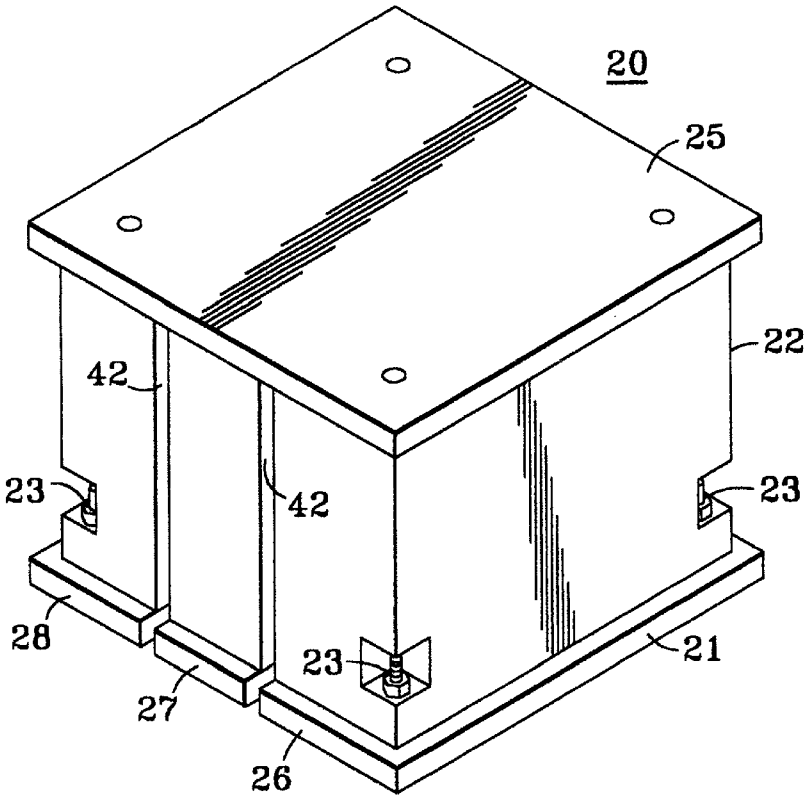
FIG. 12 is a prospective view of the head assembly used to push the completed block from the mold.

Turning to FIGS. 12 and 13, head assembly 20 consists of head plate generally designated by 21, and a metal box or head 22 to which the head plate is bolted by bolts 23. An adapter plate 25 is bolted or welded onto the top of head 22. Adapter place 25 is designed to bolt onto the head mechanism of the block manufacturing machine.

The replaceable head plate, FIG. 13, typically consists of 4 sections 26, 27, 28 and 29 bolted to the bottom of head 22 by means of recessed bolts 23. As can be seen the sections 26, 27, 28 and 29 are spaced apart to match with the slots 42 of the head which permit the head to descend past ribs 37 and 38 of the core assembly about the core 36 to eject the molded brick block 40.

Figure 10:
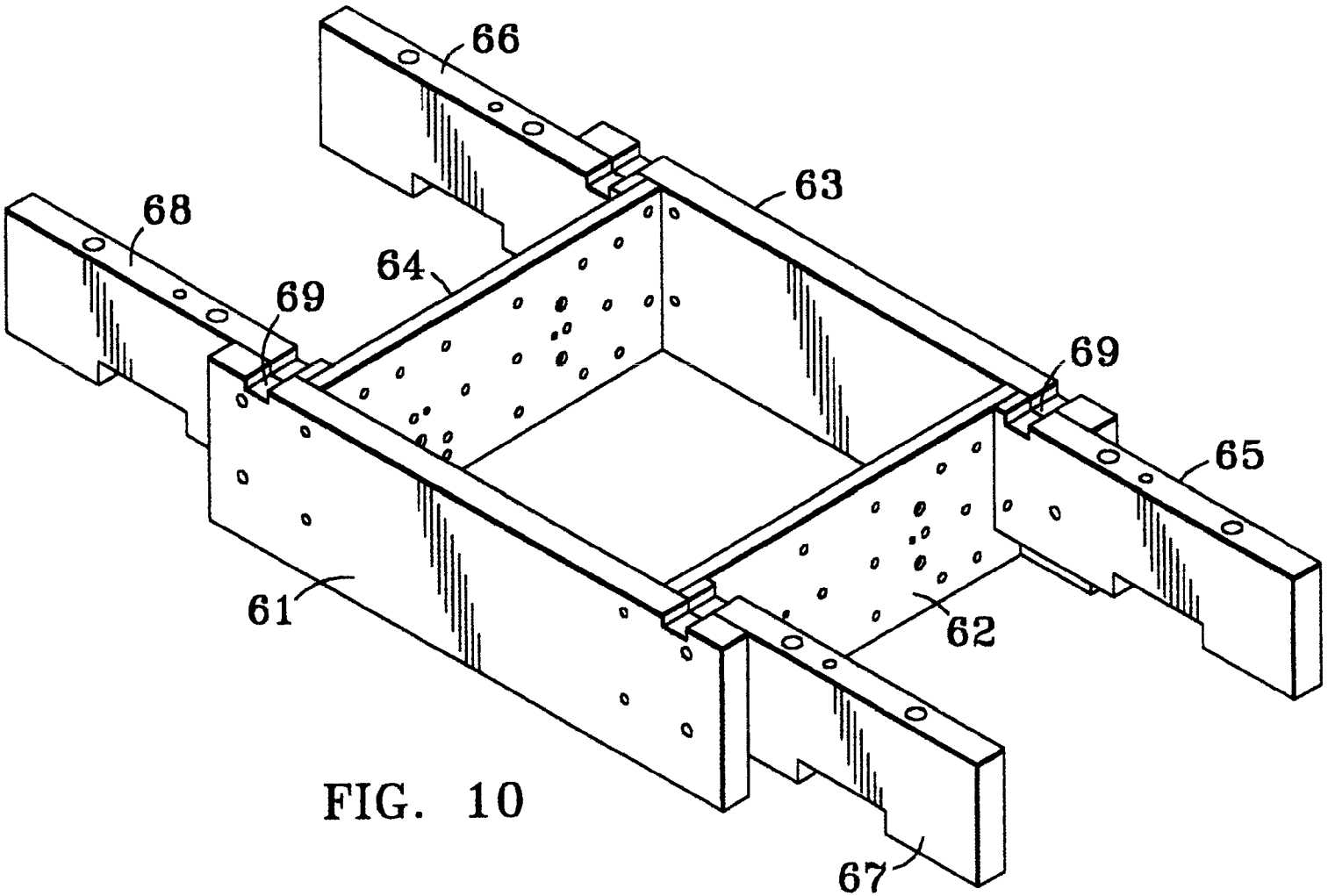
FIG. 10 is a prospective view of the frame that holds the mold and that fits into the vibrating mechanism of the block molding machine.

The mold frame 60 is shown in FIG. 10. It is a heavy metal box having walls 61, 62, 63 and 64 and flanges 65, 66, 67 and 68. The flanges are bored to be bolted to the vibrator of the block molding machine. The walls and flanges are recessed as at 69 to accommodate hydraulic lines. The walls as illustrated by walls 62 and 64 are drilled with numerous openings to accommodate the fitting of a hydraulic block on the outside and the grout bars and face plates on the inside as more fully shown in FIG. 6. Frame 60 is subjected to extremely severe punishment in service. Earlier designs failed by work hardening, stress cracking and corner breakage. For this reason walls 61 and 63 overlap their respective flanges are securely bolted to walls 62 and 64 as well as the flanges. The joints can be further strengthened by welding. Also, all holes on the frame are kept as small as possible and openings with corners such as rectangles are not used to avoid points of stress concentration.

Figure 6:
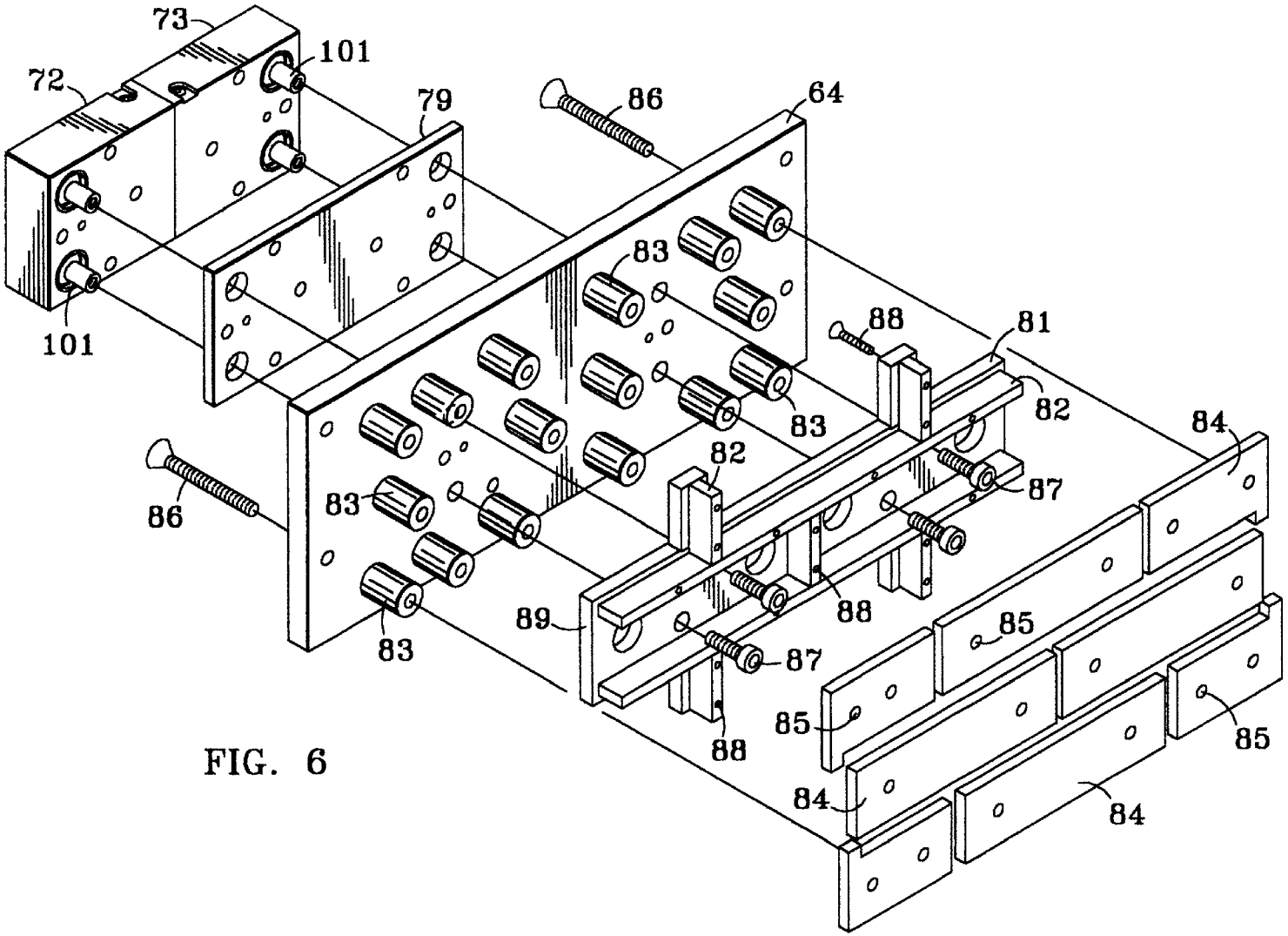
FIG. 6 is an exploded prospective view showing one hydraulic block/grout bar/face plate assembly.

In FIG. 6, the hydraulic block is shown at 72/73 and its top or retaining plate at 79. Both are attached to wall 64 of the frame by bolts not shown, although the bolt holes are. The grout bar frame 81 with the grout bars 82 are on the other side of the wall. The grout bars 82 are secured to frame 81 by countersunk bolts 88, only one of which is shown. Bolts 88 extend through holes threaded in the grout bars to be flush with the faces of the grout bars. Numerous spacers 83 extend through and around the grout bar frame. These hold the face plates 84 by means of a series of counter sunk bolts, two of which are shown at 86, extending through wall 64 and spacers 83 to seat in face plates 84 in threaded openings 85.

It is a feature of this invention to provide for a slight tapering of the face plates, i.e. to allow a draft, by sizing spacers 83 such that each tier of spacers become shorter, top to bottom. The bottom most face plates 84 are set back 1/32 to 3/32 inches, e.g. 1/16 inch, further than the top ones for the three course pattern illustrated. This facilitates ejection of the brick block from the mold.

The moveable grout bar frame 81 and bars 82, are attached to the hydraulic piston 72 of the hydraulic block 72/73 by means of bolts 87. The grout bars 82 are sized to fit tightly between the face plates 84 to prevent leakage of cement. If leakage does occur it can flow around the bars and drop out of the mold because when the grout bar is fully retracted a small clearance between it and wall 64 is provided to allow for the drainage. The grout bars 82 and face plates 84 are made of case hardened tool steel to resist wear. The hydraulic block exerts a very high pressure on the grout bar, in the order of 1800 psi or greater, such that any of the concrete mixture caught in the interstices is pulverized and flows out of the mold. Because two or more hydraulic cylinders are used towards the ends of the grout bar frame 81, the frame is pushed up against the face plates and levels thereagainst so that the grout bars are square with the faces when extended.

When retracted, the faces of grout bars 82 are flush with the faces of face plates 84. When extended, they extend 1/16 to ½ inch beyond the face plates, e.g. ⅛ inch, dimension "x" of FIG. 3. If the grout bars are not fully retracted to be flush with the face plates they will ruin the surface texture of the brick block during ejection.

As shown, the ends of grout bar frame 81 extends a grout bar thickness on either side beyond the ends of grout bars 82 to mate with the grout bars on either side. In a four-sided mold only two opposing frames have these extensions. Note the corners designated by "89" in FIG. 2.

Figure 7:
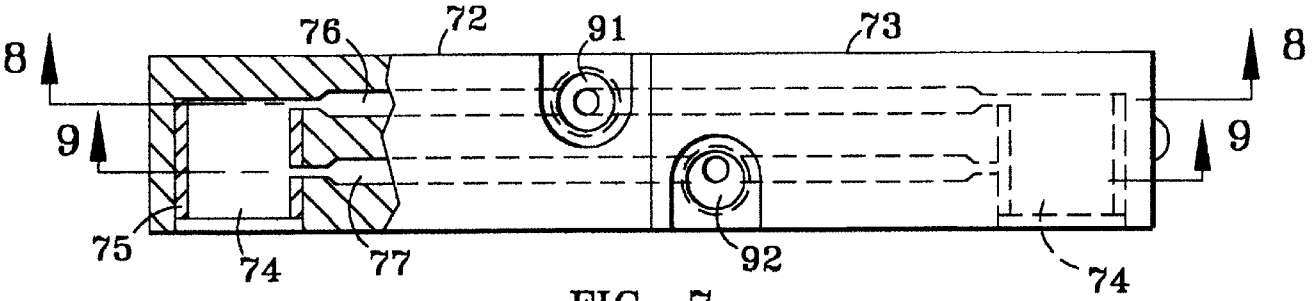
FIG. 7 is a plan view of a hydraulic block without its top plate, broken away to show the passageways for hydraulic fluid.
Figure 8:
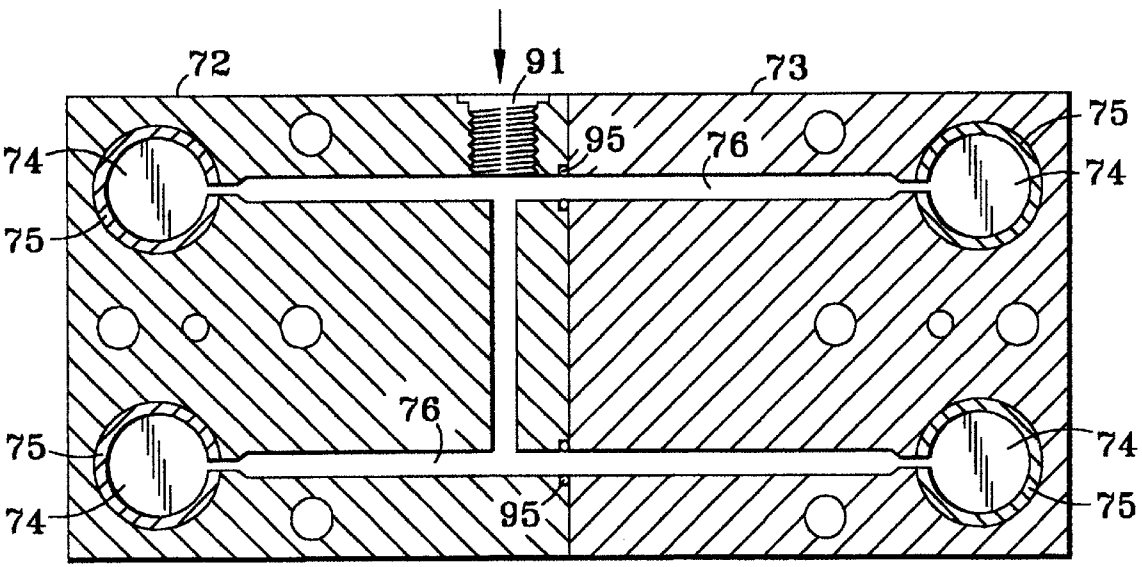
FIG. 8 is a section side view of the hydraulic block of FIG. 7 taken along line 8—8 thereof.
Figure 9:
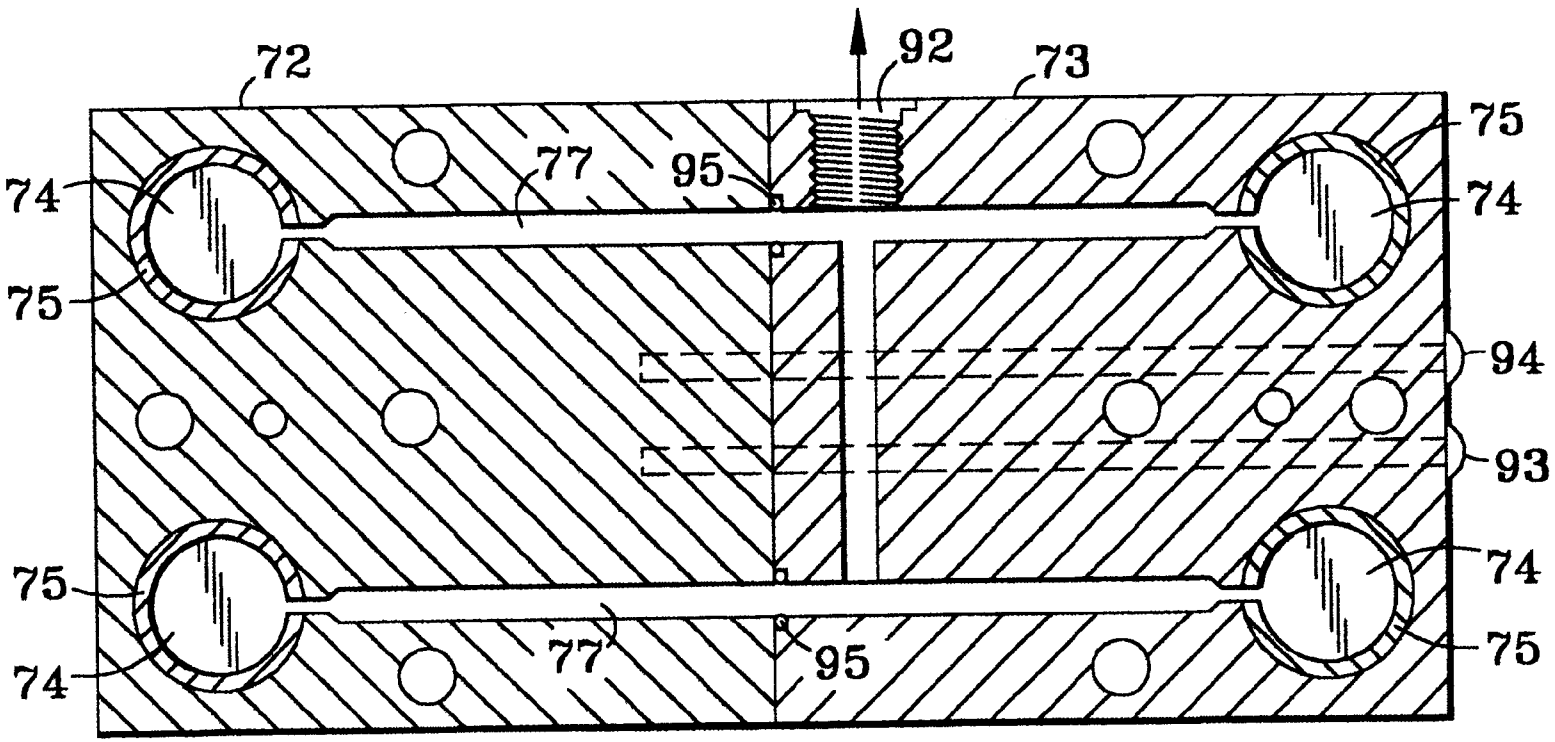
FIG. 9 is another section side view of the block taken along line 9—9 of FIG. 7.

The hydraulic block 71 is shown in FIGS. 7, 8 and 9. It is designed to provide dual action positive extension and extraction. It consists of two blocks of aluminum 72 and 73, side by side, into which are bored four chambers, two in each, 74 to receive hydraulic pistons. Chambers 74 have steel liners 75. Hydraulic passageways connect the chambers, passageways 76 for incoming pressure and passageways 77 for reverse pressure. Openings threaded to take hydraulic fittings connect the passageways, opening 91 for passageways 76 and opening 92 for passageways 77. Blocks 72 and 73 all held together by bolts 93 and 94, in addition to being bolted to the frame. O-ring seals 95 are provided to seal the joints of the passageways.

Figure 4:
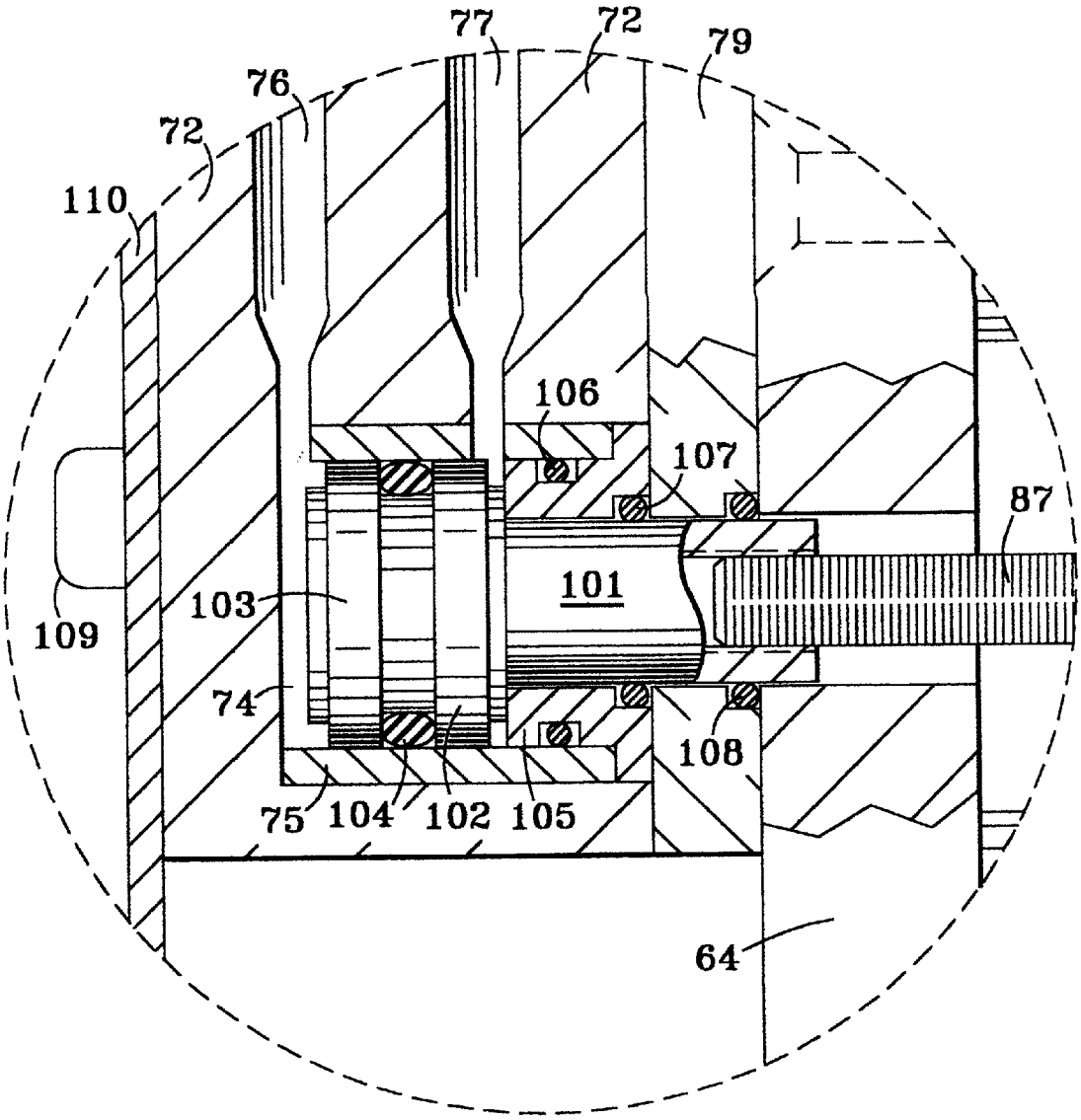
FIG. 4 is an enlarged view of that portion of the hydraulic block, circled by circle 4 in FIG. 3., showing one of the hydraulic pistons.

In FIG. 4, the one of the hydraulic pistons is shown in greater detail. A hydraulic piston 101 having two spaced apart shoulders or piston rings, 102 and 103, fits within liners 75. An O-ring seal 104 is carried between shoulders 102 and 103. A metal end cap 105 with O-ring seals 106 and 107 holds piston 101 and end cap 105 in turn is held by retaining plate 79 when the assembly is bolted to frame wall 64. Another O-ring seal 108 is provided between retaining plate 79 and wall 64. Item 109 is a bolt head of one of the bolts tying the assembly to the frame. Item 110 is simply a light metal shield used to protect the hydraulic lines.

Note that the top and bottom surface areas of the piston subject to the hydraulic pressures are not equal. The cyclic hydraulic pressures applied to each passageway are, however, applied in a known manner to assure positive extension and traction of the piston and can be as high as 1800 to 2400 psi.

Figure 2:
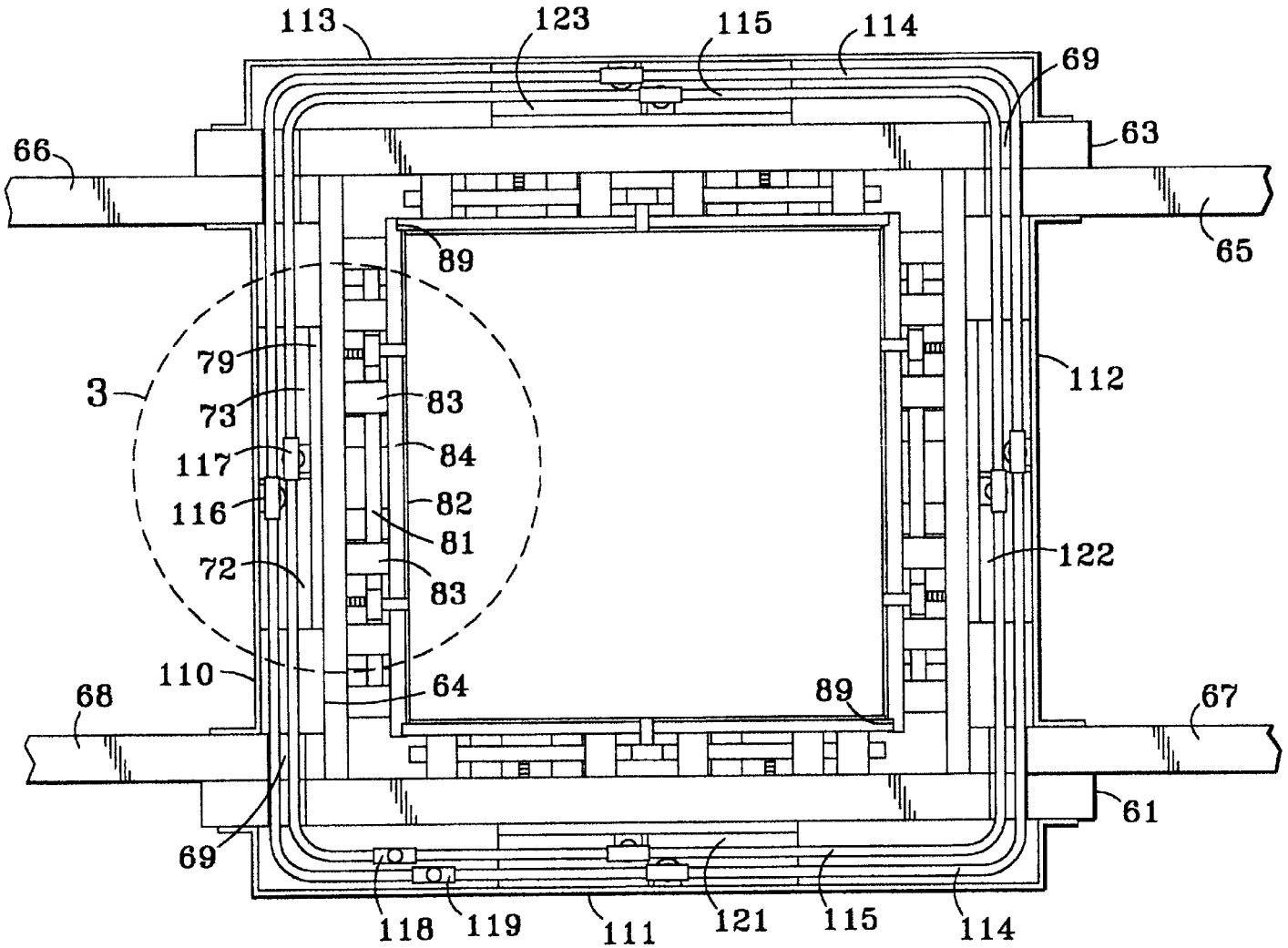
FIG. 2 is a plan view of a mold to impress a brick pattern on all four sides of a chimney block.
Figure 3:
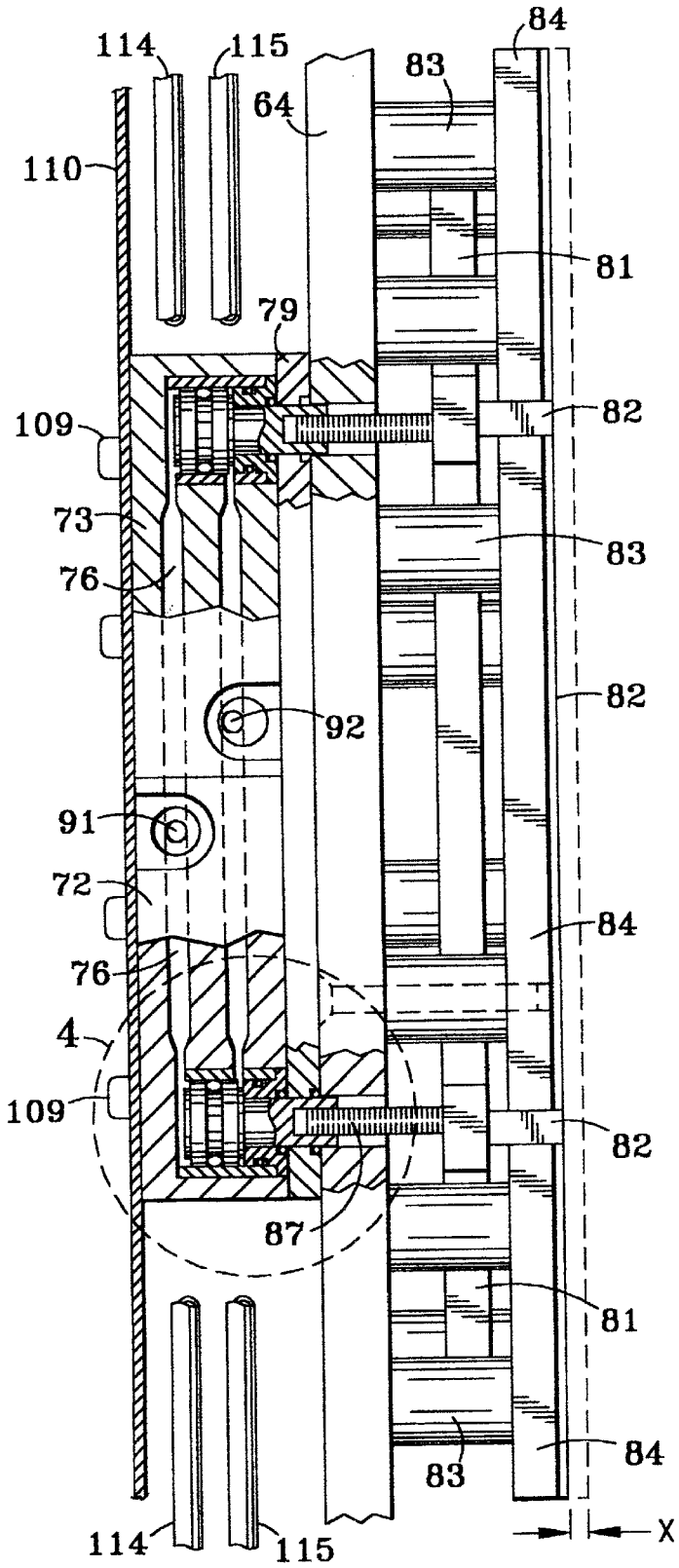
FIG. 3 is an enlarged view of the mold wall, circled by circle 3 in FIG. 2, in part broken away to show interior detail of the hydraulic block.
Figure 5:
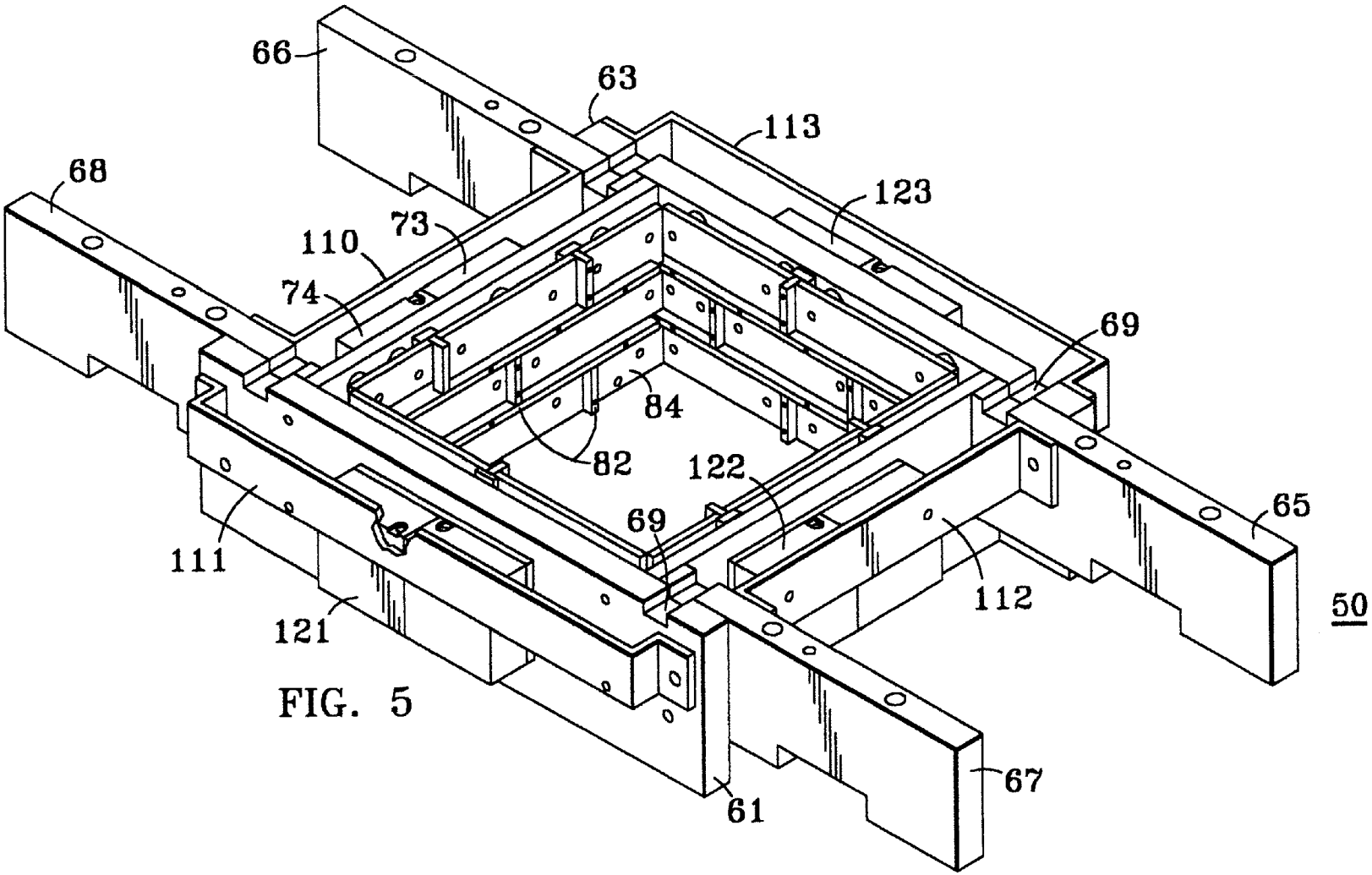
FIG. 5 is a prospective view of the mold of FIG. 2 showing in particular the face plates and the grout bars in their extended positions. The hydraulic lines are not shown in FIG. 5, nor on the frame 50 as illustrated in FIG. 1.

Finally, the assembly of the mold is shown in FIGS. 2, 3 and 5. In FIG. 5 the hydraulic lines are not shown. In FIG. 3 the piston in block 73 is the same as that in block 72 and will not be further described.

Hydraulic lines 114 and 115 encircle the mold, resting in cutouts 69 and being protected by metal shields 110, 111, 112 and 113 bolted to the frame. The hydraulic lines are connected by suitable fittings to each hydraulic block, fitting 116 to connect to part 91 and fitting 117 to connect to part 92 for block 72/73. Similarly the hydraulic lines are connected to hydraulic blocks 123, 121 and 122 on the other three sides of the mold. Hydraulic fluid is supplied to line 114 via fitting 119 and to line 115 by fitting 118.

The brick block molding apparatus operation is as follows:

A pre-sized or weighted concrete charge is pushed onto the core tray assembly 30 where it falls into opening 35 and in and around core 36. The block machine is vibrating frame 50 and the mold at this time. The mold bottom is closed by a pallet 41 being pressed up thereagainst. As the mold is being filled, the hydraulic mechanism holds the grout bards 82 extended about ⅛ inch into the mold. After the charge is in the mold and settled, vibration is stopped and the grout bars are retracted to be flush with face plates 84. Thereafter head 20 descends into the mold contacting the formed block and pushing it downwardly onto pallet 40, which is descending at the same rate as head 20. Core 36 has a spring loaded vent (not shown) as is known so that a vacuum is not formed therein which would distort the tender block.

After the finished block, a chimney block 40 in this example, clears the mold it and pallet 40 are removed and set aside to allow curing following which the grout lines are striped with a cement colored paint such as a pigmented latex. Another pallet is put into place, head 20 is retracted and the cycle is repeated. It is a preferred feature to angle the inside corners of the block at 45 degrees as shown rather than round them as this facilitates ejection and yields a stronger block. In a series of 20 or more blocks, the variation of any dimension of a block will be less than 2 percent of the average of that dimension.

It is obvious that by the above described method, blocks can be produced having an impressed brick pattern on one, two, three or all four sides as may be desired. All that is required is for the mechanisms shown in FIG. 6 to be replicated on each side where a brick pattern is desired.

The brick block apparatus of this invention uses a single hydraulic power service. The manifold/hydraulic block assembly illustrated needs only 10 fittings (for a four sided mold) to connect the lines and blocks. An earlier design required 100 fittings or so which greatly increased the opportunity for leakage and breakage.

It is a feature of this invention to use a concrete charge to the mold that is uniformly colored throughout to produce a face having a natural brick color. The concrete is formulated to 0 slump and has a high density.

The brick block product has an authentic brick appearance and is a cost efficient alternative to laying up courses of brick by hand. It is faster and easier to install and gives a better appearance when laying up wall.

Having described this invention, what is sought to be protected by Letters Patent is succinctly set forth in the following claims.

What is claimed is:

1. A process of manufacturing a brick block comprising:

a) placing a measured charge of concrete downwardly into a mold, said concrete being colored throughout to simulate the color of brick and said mold being rectangular and comprising (1) four vertical walls, (2) interior face plates on one side in a pattern of laid brick held by and spaced from the vertical wall on that side by spacers, (3) a grout bar being between each side of said face plates moveable from a position flush with said face plates inwardly to impress simulated grout lines in a pattern of laid brick on a face of said concrete as it is being molded, and (4) a hydraulic block with at least two hydraulic pistons mounted to said vertical wall on that side, said grout bar being an integral structure attached to and being moved by said hydraulic pistons;

b) vibrating said mold with said grout bar extended;

c) ceasing said vibrating and retracting said grout bar thereby completing the forming of a brick block with grout lines;

d) ejecting said brick block downwardly onto a pallet, and e) setting said brick block aside to cure.

2. The process of claim 1 wherein said mold has a single central core to provide a chimney block and wherein all said four vertical walls have face plates and grout bars providing said simulated grout lines on each vertical face of said brick block, said grout bars being moved in unison by hydraulic pistons contained in hydraulic blocks on each side of said mold activated by hydraulic fluid from a common source.

3. The process of claim 1 wherein said face plates have a pattern of laid brick at least three courses high and have a draft in the direction of ejection of said brick block.

4. Apparatus for the manufacture of brick block comprising:

a) a rectangular mold with four vertical walls and open at the top and bottom, said rectangular mold having interior face plates on one side in a pattern of laid brick held by and spaced from the vertical wall on that side by spacers, a grout bar between each said face plate moveable from a position flush with said face plates inwardly to impress simulated grout lines in a pattern of laid brick on a face of said concrete as it is being molded and a hydraulic block with at least two hydraulic pistons mounted to the vertical wall on said one side, said grout bar being an integral structure attached to and being moved by said hydraulic pistons;

b) a platen closing the bottom of said rectangular mold and moveable downwardly to receive a completed brick block;

c) a core fitting within said rectangular mold held from the top by ribs that permit a concrete charge to flow around said core into said mold;

d) charging means for placing a presized charge of concrete into said mold;

e) vibrating means for vibrating said mold while said mold is being charged;

f) ejection means adapted to descend downwardly about said ribs and core and push said brick block from said rectangular mold, and g) a source of hydraulic fluid operatively connected to said hydraulic block and hydraulic pistons;

the thickness of said grout bar being sufficient to seal the spaces between said interior face plates so as to prevent by and large any leakage of said charge behind said interior face plates.

5. The apparatus of claim 4 wherein said hydraulic block is mounted to the vertical wall on said one side on the outside thereof, wherein said grout bar is carried on a grout bar plate to which said hydraulic pistons attach and wherein when retracted there is a space between said grout bar frame and the vertical wall on said one side.

6. The apparatus of claim 5 wherein all said four vertical walls hold with spacers like face plates with their respective grout bars, each grout bar being operatively connected by at least two pistons to individual hydraulic blocks on each side of said rectangular mold, said hydraulic blocks all being operatively connected to a common source of hydraulic fluid.

* * * * *